US007165751B2

(12) United States Patent
De'Longhi

(10) Patent No.: US 7,165,751 B2
(45) Date of Patent: Jan. 23, 2007

(54) SUPPORT FOR A RADIATOR

(75) Inventor: Giuseppe De'Longhi, Treviso (IT)

(73) Assignee: De' Longhi S.p.A., Treviso (IT)

( * ) Notice: Subject to any disclaimer, the term of this patent is extended or adjusted under 35 U.S.C. 154(b) by 5 days.

(21) Appl. No.: 10/495,243

(22) PCT Filed: Sep. 20, 2002

(86) PCT No.: PCT/EP02/10578

§ 371 (c)(1),
(2), (4) Date: May 6, 2004

(87) PCT Pub. No.: WO03/042608

PCT Pub. Date: May 22, 2003

(65) Prior Publication Data

US 2004/0245417 A1 Dec. 9, 2004

(30) Foreign Application Priority Data

Nov. 14, 2001 (IT) ..... MI2001A2399

(51) Int. Cl.
*F24H 9/06* (2006.01)

(52) U.S. Cl. ..... 248/232; 248/129; 248/346.01

(58) Field of Classification Search ..... 248/232, 248/346.01, 346.03, 129, 213.3, 214, 213.4; 269/55, 901, 905, 909
See application file for complete search history.

(56) References Cited

U.S. PATENT DOCUMENTS

| | | | | |
|---|---|---|---|---|
| 2,446,518 | A * | 8/1948 | Arnold et al. | 410/2 |
| 4,157,798 | A * | 6/1979 | Lin | 248/647 |
| RE35,627 | E * | 10/1997 | Estrem | 144/329 |
| 6,019,235 | A * | 2/2000 | Ferrigan | 211/195 |
| 6,412,746 | B1 * | 7/2002 | Davis et al. | 248/519 |
| 6,439,515 | B1 * | 8/2002 | Powers | 248/129 |

FOREIGN PATENT DOCUMENTS

| | | |
|---|---|---|
| FR | 874 910 | 8/1942 |
| FR | 936 132 | 9/1948 |
| FR | 1 134 607 | 4/1957 |
| SU | 1457348 | 9/1990 |

* cited by examiner

*Primary Examiner*—Amy J. Sterling
(74) *Attorney, Agent, or Firm*—Andrew Wilford

(57) ABSTRACT

The support for a radiator of the mobile type comprises ja frame which has means for connecting to said radiator and retractable means for supporting the radiator on a floor. The support means are suitable for taking up a working position outside of the shape of said frame or else a low encumbrance position inside the shape of said radiator. The procedure for mounting or dismounting a support for a radiator of the mobile type to allow its use or else its suitably packaged transportation, respectively, comprises the steps of moving the bases, which carry wheels connected so that they can rotate, with respect to the frame, taking them into a working position outside of the shape of said frame or else into a low encumbrance position inside the frame of said radiator.

8 Claims, 5 Drawing Sheets

SUPPORT FOR A RADIATOR

CROSS REFERENCE TO RELATED APPLICATIONS

This application is a national stage of PCT/EP02/10578 filed 20 Sep. 2002 and based upon Italian national application Mi 2001 A 002399 of 14 Nov. 2001 under the International Convention.

FIELD OF THE INVENTION

The present invention refers to a radiator support of the mobile type and to a method of mounting or dismounting the aforementioned support.

BACKGROUND OF THE INVENTION

As is known, radiators of the mobile type have a plurality of feet or wheels which allow them to be supported and moved. The wheels are directly connected to the radiator by means of screw stays and wing nuts.

However, supports of the traditional type have to be assembled by the buyer of the radiator after sale, with the risk of the support being mounted incorrectly and, moreover, of losing one or more components to be mounted, in particular small sized components such as nut washers or the like.

OBJECT OF THE INVENTION

The object of the present invention is, therefore, to provide a radiator support of the mobile type and a method of mounting or dismounting the aforementioned support which allows the aforementioned technical drawbacks of the prior art to be eliminated.

Another object of the invention is to provide a support which does not have to be mounted by the user after assembly.

Advantageously, indeed, the support according to the present finding is ready mounted and only has to be put into a "working" configuration to be able to be used, or else a "low encumbrance" configuration to be able to be packaged.

Another object of the invention is to provide that of realising a support which does not have the risk of losing one or more of its components, either before or after the radiator is bought.

In particular, the support does not have parts (in particular small in size) which are separated from the rest of the support itself or from the radiator, which could be lost.

A last but not least object of the invention is to provide a support and a method which allows the transportation of a radiator with the support connected to it but with limited encumbrance, so as to limit size of the packaging for containing the radiator.

SUMMARY OF THE INVENTION

These and other objects of the present invention are achieved in a support for a radiator of the mobile type, which comprises a frame which has means for connecting to said radiator and retractable means for supporting the radiator on a floor. The support means is suitable for taking up a work position outside of the shape of said frame or else a low encumbrance position inside the shape of said radiator.

The present invention also relates to a method of mounting or dismounting a support for a radiator of the mobile type to allow it to be used or else to be transported suitably packaged. The method comprises the steps of displacing bases which carry wheels connected in a rotatable manner with respect to a frame, putting them into a work position outside of the shape of said frame or else in a low encumbrance position inside the shape of said radiator.

The support means can comprise one or more bases to which wheels are rotatably connected. The support can have at least one hinge for connecting the frame to each of said bases. At least one of the hinges can have its axis substantially parallel to the floor.

The frame and one or more bases can have conjugated joint portions which are connected to each other when the bases take up the working position. These portions can be suitable for transmitting the stresses so as to limit the stresses transmitted to the hinge. The joint means which extends from the frame can protrude from an opposite side with respect to the wheels. The joint portion which extends from said frame can comprise a substantially L-shaped element and, correspondingly, the joint portion of the one or more bases can comprise a hollow suitable for receiving the L-shaped element.

The joint portion which extends from said frame can comprise a deep-drawn part formed on the plate of said frame and, correspondingly, the joint portion of the bases can comprise a portion suitable for receiving said deep-drawn part. First snap or friction locking means can be provided for the bases in the working position.

Second snap or friction locking means can be provided for the bases in the low encumbrance position.

The connection means can comprise at least one bracket the ends of which are connected to the frame and the central part of which is suitable for receiving a hub of the radiator.

The hinge can have an axis substantially perpendicular to said floor.

At least one of the bases can be slidably connected to said frame.

The method of mounting or dismounting a support for a radiator of the mobile type to allow its use or else its suitably packaged transportation, respectively, can comprise the steps of moving the bases, which carry wheels connected so that they can rotate, with respect to the frame, taking them into a working position outside of the shape of the frame or else into a low encumbrance position inside the frame of said radiator. After the bases have been moved, snap or friction locking elements can hold said bases in position lock.

BRIEF DESCRIPTION OF THE DRAWING

Further characteristics and advantages of the invention shall become more clearer from the description of a preferred but not exclusive embodiment of the support for a radiator of the mobile type and of the method of mounting or dismounting the aforementioned support, referring to the attached drawings, in which.

SPECIFIC DESCRIPTION

Figure 1:
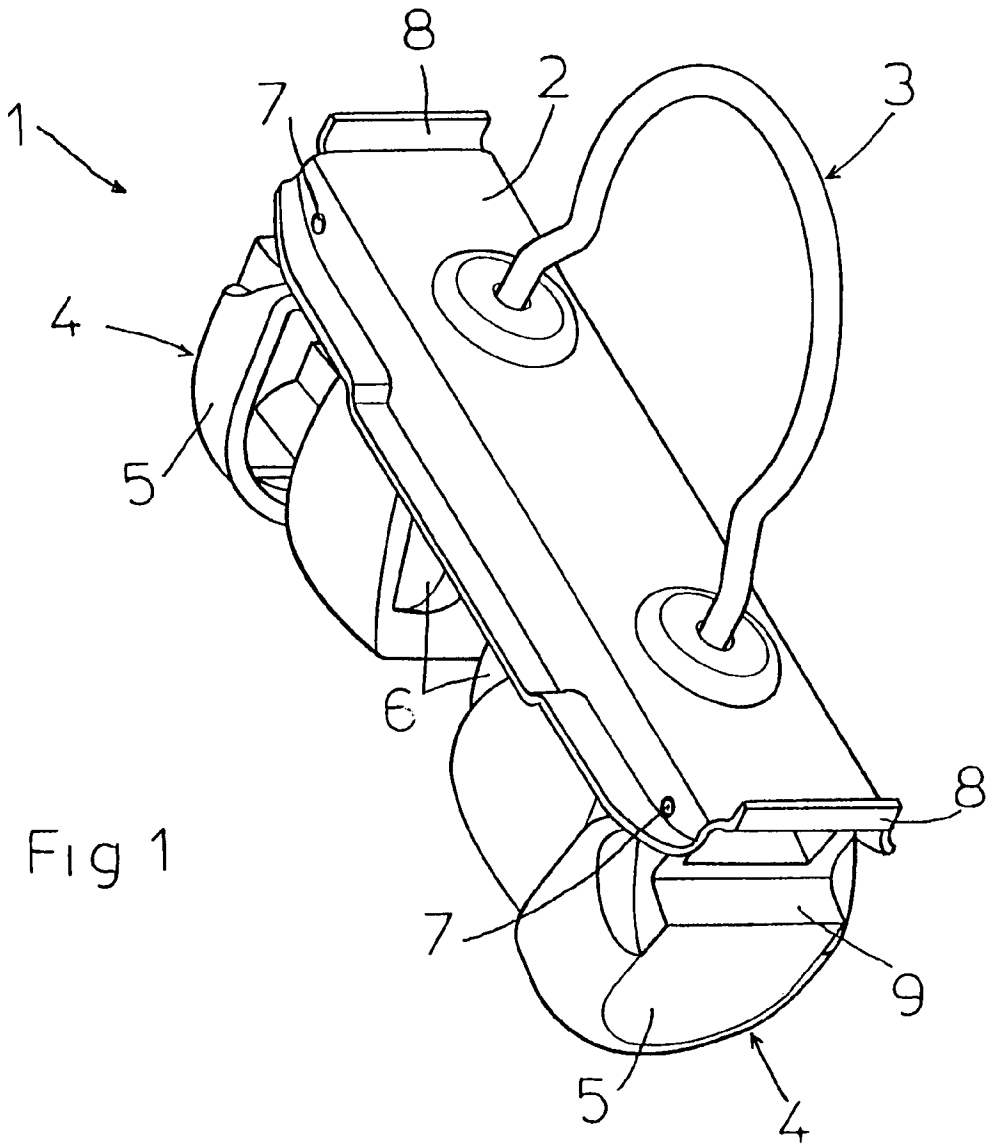
FIG. 1 shows a perspective view of a support according to the finding in a low encumbrance configuration.
Figure 6:
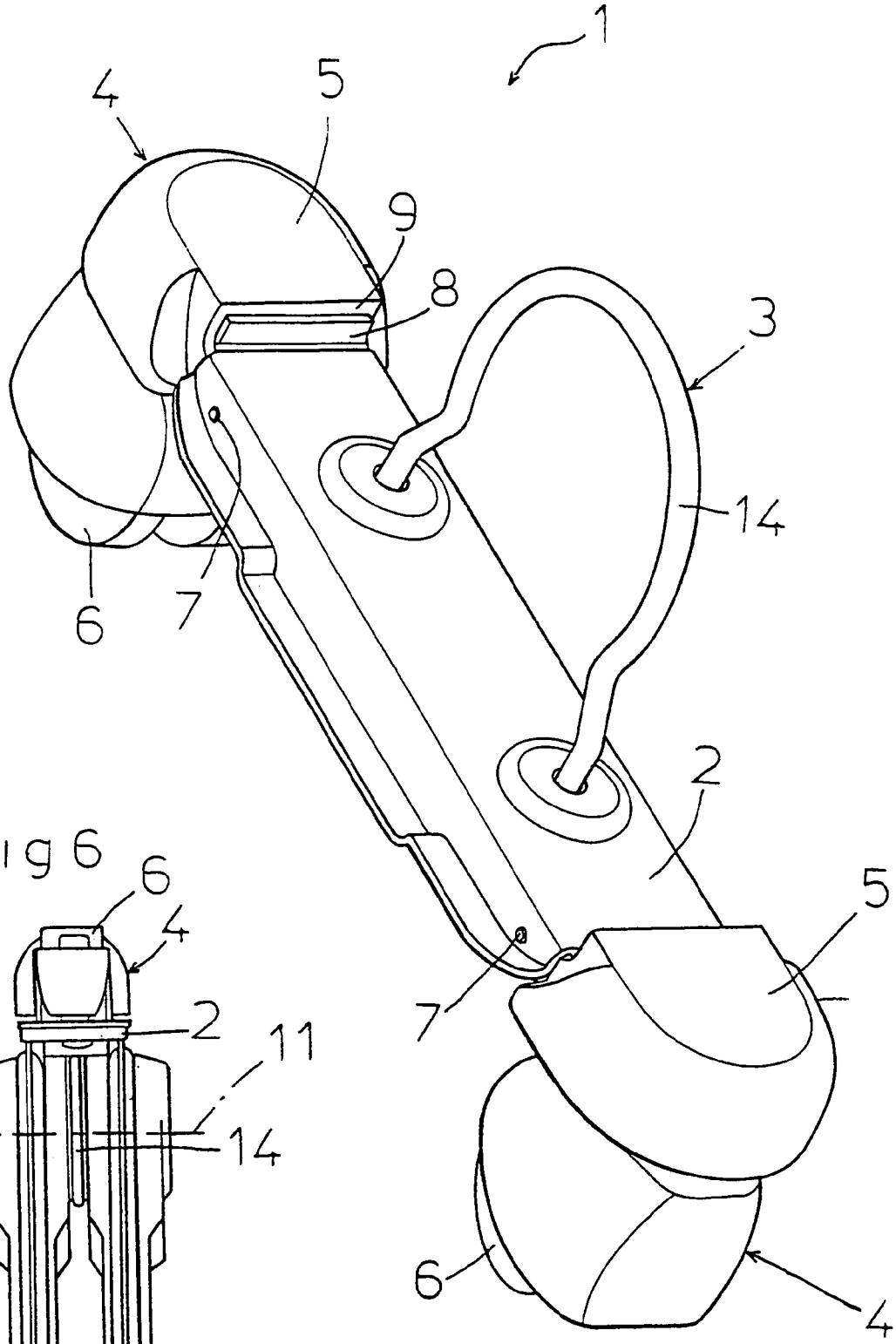
FIG. 6 shows a side view of a mobile radiator on which a support according to the present invention is mounted.
Figure 2:
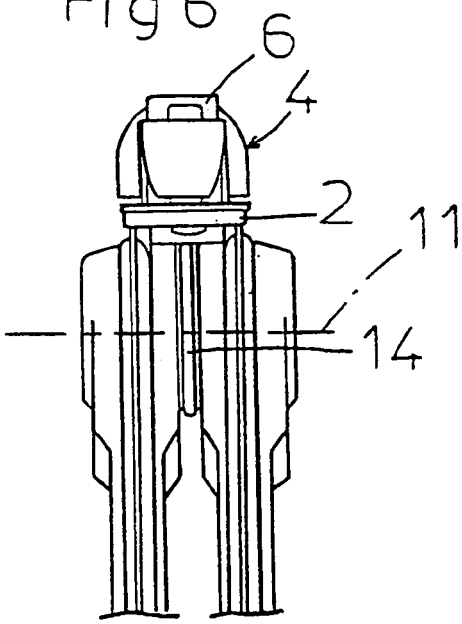
FIG. 2 shows a perspective view of the support of FIG. 1 in a working configuration.
Figure 3:
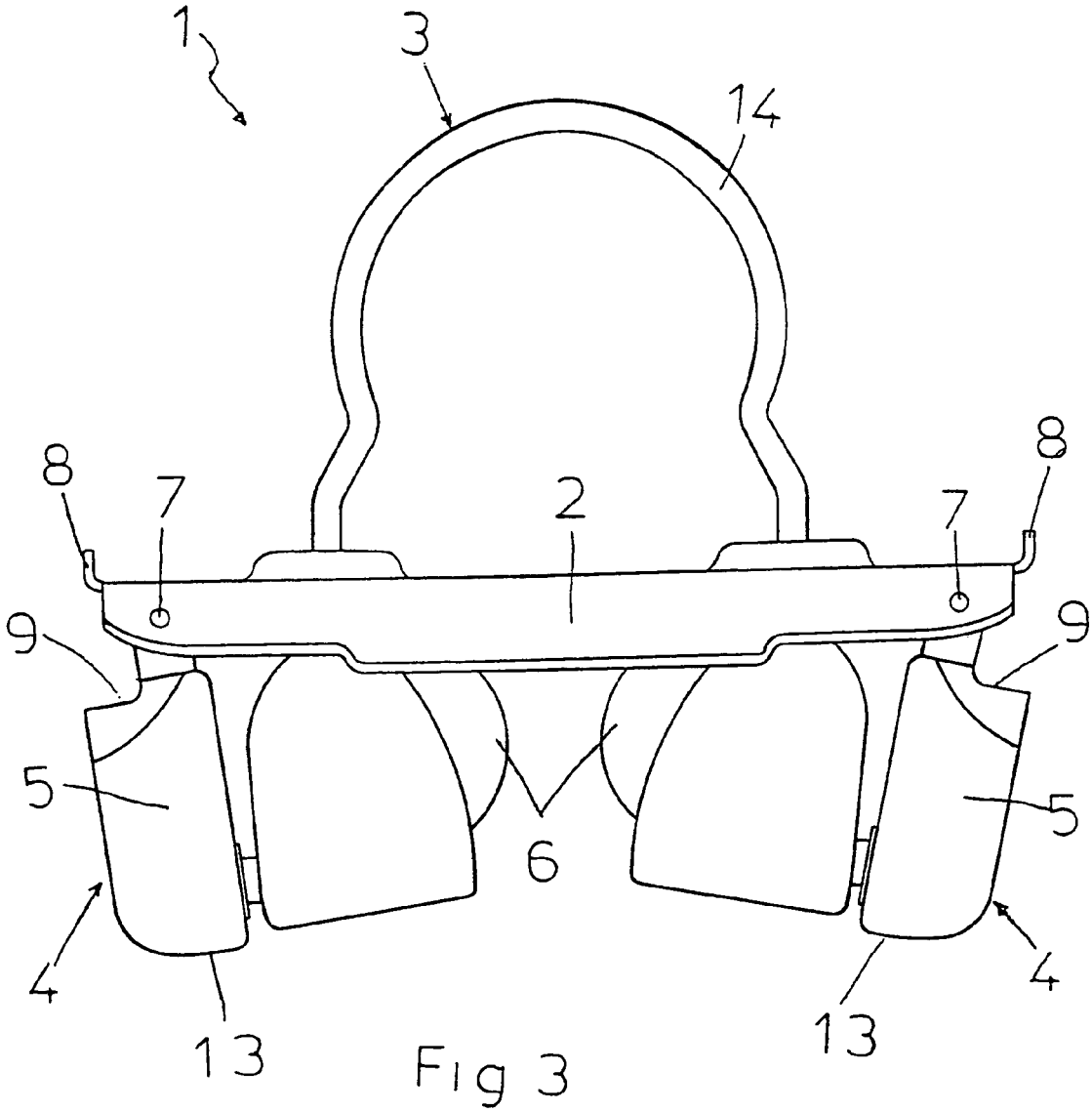
FIG. 3 shows a side view of the support of FIG. 1 in a low encumbrance configuration.
Figure 4:
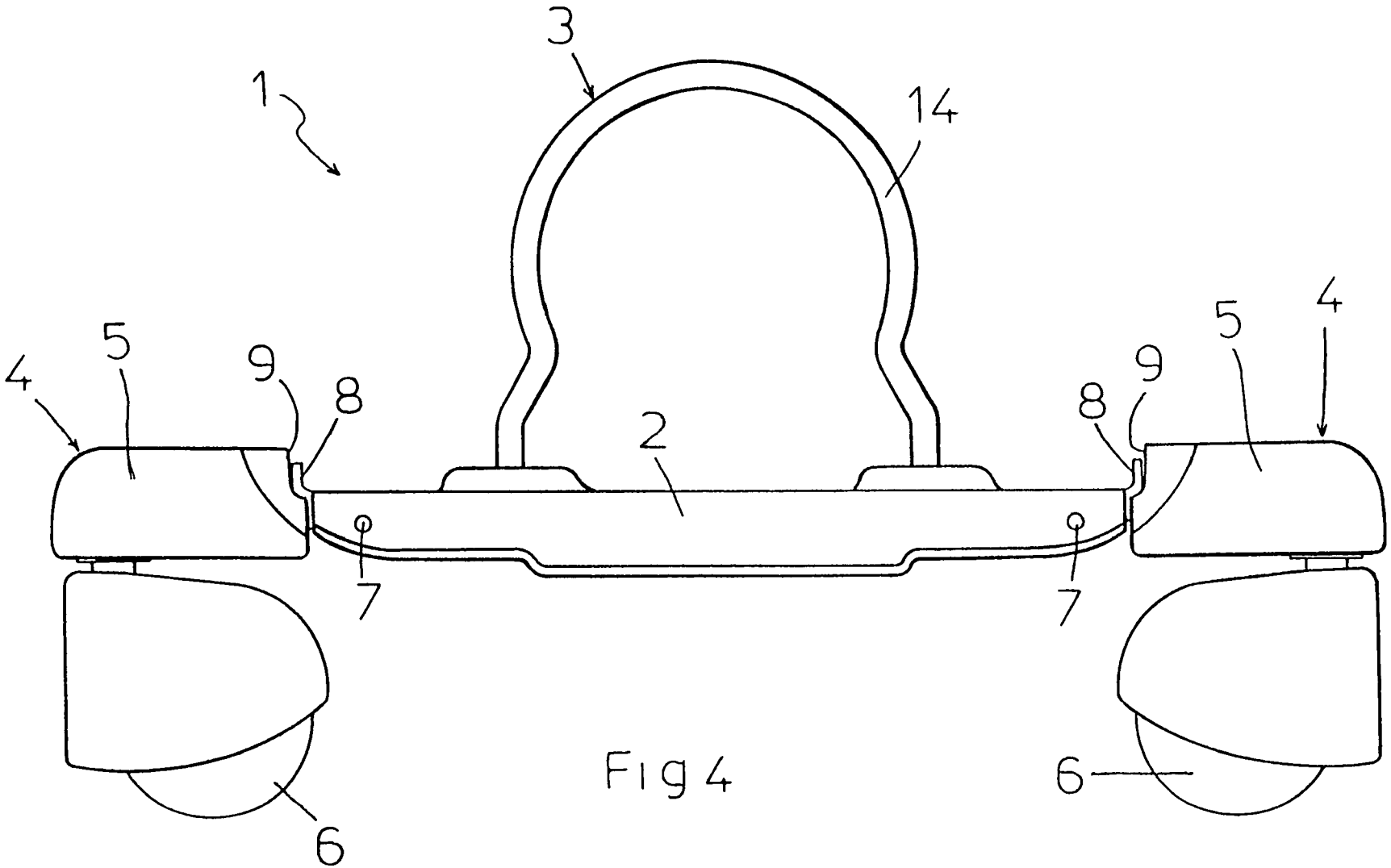
FIG. 4 shows a side view of the support of FIG. 1 in a working configuration.
Figure 5:
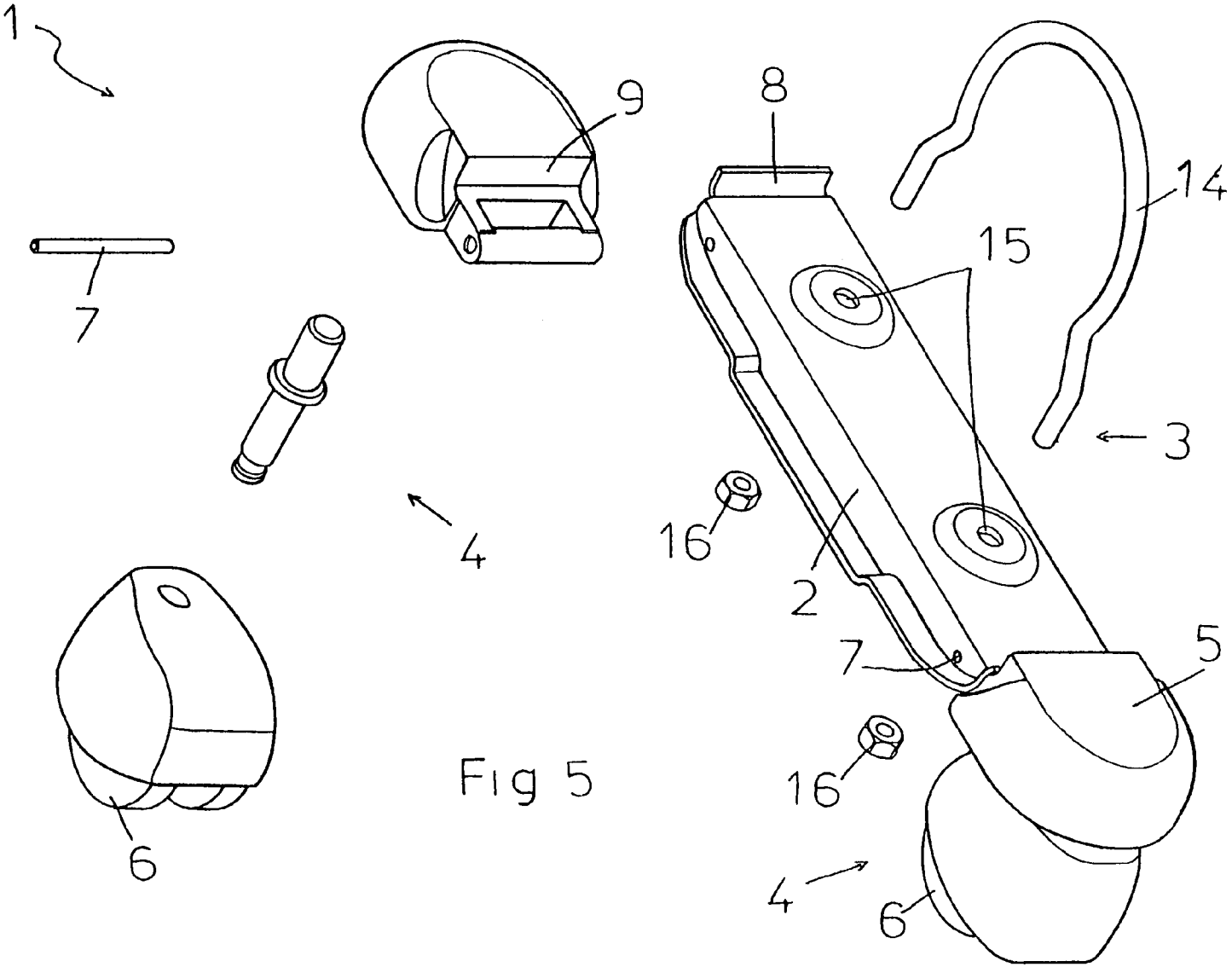
FIG. 5 shows an exploded perspective view of the support of FIG. 1.

With reference to the mentioned FIGS., a support for a radiator of the mobile type is shown at 1.

The support 1 comprises a frame 2 which has means 3 for connecting to the radiator and retractable support means 4 for supporting the radiator on a floor.

Advantageously, the support means 4 are suitable for taking up a working position outside of a shape of the frame 2 or else a lower encumbrance position inside the shape of the radiator.

The support means 4 preferably comprise one or more bases (in the example shown two bases) to which wheels 6 are rotatably connected.

The support 1 comprises at least one hinge 7 for connecting the frame 2 to each of the bases 5.

Preferably, as shown in the attached figures, the hinges 7 have an axis substantially parallel to the floor, that is the axis is substantially horizontal and parallel to the transverse axis 11 of the radiator.

In practice, therefore, when the bases 5 rotate about the hinges 7 going to a low encumbrance position, they go below the frame 2 (that is inside the shape of the frame 2), whereas when the bases 5 rotate about the hinges 7 going to the working position they are outside of the frame shape 2. Advantageously, the frame 2 and the bases 5 have conjugated joint portions 8, 9 which are connected to each other when the bases 5 take up the working position.

The joint portion 8, 9 are suitable for transmitting stresses so as to limit the stresses transmitted to the hinge 7.

Suitably, so as to optimize the stress distribution the joint portion 8 which extends from the frame 2 comprises an L-shaped element integral with the plate of the frame 2 and, correspondingly, the joint portion 9 of the bases 5 comprises a hollow suitable for receiving the L-shaped element.

In a different embodiment, not shown for the sake of simplicity in the drawings, the joint portion which extends from the frame comprises a deep-drawn part on the plate of the frame and, correspondingly, the joint portion of the bases comprises a portion, for example hollow, suitable for receiving the deep-drawn part.

Preferably, the support 1 comprises first snap or friction locking means of the bases 5 in working position (not shown for the sake of simplicity) and second snap or friction locking means of the bases 5 in low encumbrance position. Advantageously, the second locking means lock the bases 5 so that a portion of the base 5 itself indicated with 13 constitutes the support on a floor of the radiator.

The connection means 3 comprise a bracket 14 the ends of which are connected to the frame 2 and the central part of which is suitable for receiving a hub of the radiator. As shown in the attached figures, the bracket 14 has ends which are threaded and inserted into through-holes 15 of the frame 2 and here are locked through nuts 16.

In a different embodiment, not shown in the drawing, the hinge has its axis substantially perpendicular to the floor, that is the axis is substantially vertical and perpendicular to the transversal axis 11 of the radiator.

In a further embodiment (also not shown in the attached figures), the bases 5 are slidably connected to the frame 2. The operation of the support for a radiator of the mobile type according to the invention can be seen clearly from that which is described and illustrated and, in particular, it is substantially the following.

The packaged radiator has a support ready-mounted with the bases 5, in a low encumbrance position, locked through the second locking means.

In this way the radiator is rested upon the portions 13 of the bases 5 and has a very low encumbrance since the bases 5 do not protrude from the frame 2 and/or from the shape of the radiator.

Advantageously, the packaging is small in size, limiting encumbrance and costs.

When the radiator is bought, the end user rotates the bases 5, unlocking the second locking means, until the first locking means are snapped to take the bases 5 into working position.

With the bases in working position the radiator can be moved (since it is rested upon wheels) and is very stable (since the wheels are separated by a large distance from each other). The present finding also refers to a procedure for mounting or dismounting a support 1 for a radiator of the mobile type to allow its use or else its suitably packaged transportation, respectively.

The procedure comprises the steps of moving the bases 5 which carry the wheels 6 connected so that they can rotate with respect to the frame 2, taking them into a working position outside of the shape of the frame or else into a low encumbrance position inside the shape of said radiator.

Preferably, after the bases 5 have been displaced, the snap or friction locking elements which hold the bases 5 in position lock.

In practice, it has been noted how the support for a radiator of the mobile type and the procedure for mounting or dismounting the aforementioned support according to the invention are particularly advantageous because they do not require the user to have to assemble and/or connect numerous loose pieces together.

Moreover, the radiator is small in size, limiting the packaging sizes for transportation and, at the same time, the radiator is very stable when it is used.

The support for a radiator of the mobile type and the procedure for mounting or dismounting the aforementioned support thus conceived are susceptible to numerous modifications and variants, all covered by the inventive concept; moreover, all of the details can be replaced with technically equivalent elements. In practice, the materials used, as well as the sizes, can be whatever according to the requirements and the state of the art.

The invention claimed is:

1. A mobile-radiator package, comprising:

an upright mobile radiator; and a support for said mobile radiator including:

an elongated horizontal plate, a connector on said plate for securing said radiator onto an upper surface of said plate so that said support underlies said radiator and is attached thereto;

a respective support member at each end of said plate swingably connected directly to said plate for displacement between a working position wherein each support member lies outside an outline of said plate and of said radiator and longitudinally extends from the plate, and a low-encumbrance position in which each support member lies within the outline of the plate and to said radiator, and a respective wheel assembly swivelably connected to each of said support members about an axis perpendicular to the respective support member and having wheels riding on a floor in said working position and lying directly below said plate and within the outline of the plate and of said radiator in said low-encumbrance position, each of said support members forming a base for the respective wheel assembly.

2. The mobile-radiator package defined in claim 1 wherein each said base is connected to said plate by a hinge transverse to said plate below an underside of said plate and within said outline of said plate, each of said hinges being substantially parallel to the floor.

3. The mobile-radiator package defined in claim 2 wherein each base and said plate have conjugated joint portions at the respective hinge for absorbing stress in said working position and thereby limiting stress applied to the respective hinge.

4. The mobile-radiator package defined in claim 3 wherein the conjugated joint portions include a projection at each end of said plate and an abutment on the respective base engaging the projection in the working position.

5. The mobile-radiator package defined in claim 4 wherein said projection is generally L-shaped and the abutment is a flank of a recess in the respective base receiving the projection in the working position.

6. The mobile-radiator package defined in claim 2, further comprising a respective first snap or friction lock releasably retaining each of said bases in the working position.

7. The mobile-radiator package defined in claim 5, further comprising a respective second snap or friction lock releasably retaining each of said bases in the low-encumbrance position.

8. The mobile-radiator package defined in claim 1 wherein said connector comprises a bracket having opposite ends connected to ends of said plate and a central portion configured to engage a hub of the radiator.

* * * * *